US008426097B2

(12) United States Patent
Shin et al.

(10) Patent No.: US 8,426,097 B2
(45) Date of Patent: Apr. 23, 2013

(54) ELECTROPHOTOGRAPHIC TONER AND METHOD OF PREPARING THE SAME

(75) Inventors: Yo-da Shin, Incheon Metropolitan (KR); Jun-young Lee, Seoul (KR); Jae-hwan Kim, Seoul (KR); Tae-hoe Koo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 532 days.

(21) Appl. No.: 12/630,057

(22) Filed: Dec. 3, 2009

(65) Prior Publication Data

US 2010/0196813 A1 Aug. 5, 2010

(51) Int. Cl.
*G03G 9/00* (2006.01)

(52) U.S. Cl.
USPC ..... 430/110.3; 430/108.7; 430/108.5; 430/108.4; 430/108.8

(58) Field of Classification Search ..... 430/110.3, 430/108.7, 108.5, 108.4, 108.8
See application file for complete search history.

(56) References Cited

U.S. PATENT DOCUMENTS

| | | | | |
|---|---|---|---|---|
| 5,935,753 | A | 8/1999 | Ohishi et al. | |
| 6,733,944 | B2 * | 5/2004 | Kadokura et al. | 430/124.3 |
| 2009/0155700 | A1 | 6/2009 | Pang et al. | |
| 2010/0092886 | A1 * | 4/2010 | Vanbesien et al. | 430/137.14 |

FOREIGN PATENT DOCUMENTS

| | | |
|---|---|---|
| EP | 0962832 | 12/1999 |
| EP | 1054299 | 11/2000 |

OTHER PUBLICATIONS

European Search Report issued on Jan. 26, 2011 in EP Application No. 10152095.5.

* cited by examiner

*Primary Examiner* — Thorl Chea
(74) *Attorney, Agent, or Firm* — Stanzione & Kim, LLP

(57) ABSTRACT

An electrophotographic toner including a latex, a coloring agent, and a release agent, wherein a difference between an average circularity of toner having a particle size of D16p or less (S16) and an average circularity of toner having a particle size of D50p or less (S50) is about 0.01 or less, wherein the circularity is measured using a flow particle image analyzer (FPIA), and the ratio of an area of wax to a total cross-sectional area of the toner having a particle size of D16p or less is about 8/100 or greater, and wherein the area is measured using a transmission electron microscope (TEM).

7 Claims, 2 Drawing Sheets

ELECTROPHOTOGRAPHIC TONER AND METHOD OF PREPARING THE SAME

CROSS-REFERENCE TO RELATED APPLICATIONS

This application claims priority under 35 U.S.C. §119(a) from Korean Patent Application No. 10-2009-0008538, filed on Feb. 3, 2009, in the Korean Intellectual Property Office, the disclosure of which is incorporated herein in its entirety by reference.

BACKGROUND

1. Field of the Invention

The present general inventive concept relates to an electrophotographic toner and a method of preparing the same.

2. Description of the Related Art

In an electrophotographic process or an electrostatic recording process, a developer used to visualize an electrostatic image or an electrostatic latent image may be classified into a two-component developer formed of toner and carrier particles or a one-component developer formed of only toner. The one-component developer may be classified into a magnetic one-component developer or a nonmagnetic one-component developer. Fluidizing agents such as colloidal silica are often added to the nonmagnetic one-component developer to increase a fluidity of the toner. Typically, coloring particles, obtained by dispersing a coloring agent such as carbon black or other additives in a latex, are used in the toner.

Methods of preparing toner include pulverization and polymerization. In the pulverization method, the toner is obtained by melting and mixing synthetic resins with coloring agents and, if required, other additives, and by pulverizing the mixture and sorting the particles until particles of a desired size are obtained. In the polymerization method, a polymerizable monomer composition is manufactured by uniformly dissolving or dispersing various additives, such as a coloring agent, a polymerization initiator and, if required, a cross-linking agent and an antistatic agent, in a polymerizable monomer. Then, the polymerizable monomer composition is dispersed in an aqueous dispersive medium, which includes a dispersion stabilizer, using an agitator to shape minute liquid droplet particles. Subsequently, a temperature of the mixture is increased and suspension polymerization is performed to obtain polymerized toner having coloring polymer particles of a desired size.

In an image forming device, such as an electrophotographic device or an electrostatic recording device, an image is formed by exposing an image on a uniformly charged photoreceptor to form an electrostatic latent image, attaching toner to the electrostatic latent image to form a toner image, transferring the toner image onto a transfer medium such as transfer paper, or the like, and then fixing the toner image on the transfer medium by any of a variety of methods, including heating, pressurizing, solvent steaming, and the like. In most fixing processes, the transfer medium with the toner image disposed thereon passes through fixing rollers and pressing rollers, and the toner image is fused to the transfer medium by heat and pressure.

Images formed by an image forming apparatus such as electrophotocopier should satisfy requirements of high precision and accuracy. Conventionally, toner used in an image forming apparatus is usually obtained by using the pulverization method. In the pulverization method, color particles having a large range of toner particle size distribution are formed. However, in order to obtain satisfactory developing properties, there is a need to sort the coloring particles obtained through pulverization according to size so as to reduce the particle size distribution. However, it is difficult to precisely control the particle size and the particle size distribution using a conventional mixing/pulverizing process in the manufacture of the toner which is suitable for an electrophotographic process or an electrostatic recording process. Also, when preparing a fine particle toner, the toner preparation yield is adversely affected by the sorting process. In addition, there are limits to the change/adjustment of a toner design in order to obtain desirable charging and fixing properties.

Accordingly, polymerized toner, the size of particles of which is easy to control and which does not need to undergo a complex manufacturing process such as sorting, has been highlighted recently. When toner is prepared through polymerization, polymerized toner having a desired particle size and the particle size distribution may be obtained without pulverizing or sorting.

In this regard, a viscosity of the polymerized toner needs to be decreased. In addition, viscosity of the polymerized toner needs to be optimized so that the polymerized toner is easily peeled off from paper and is prevented from hot-offset development. The viscosity of the polymerized toner may be optimized by controlling a degree of crosslinking and by using a low-melting point/low-viscosity wax. However, if the low-melting point/low-viscosity wax is used to increase glossiness, the wax dispersed in the toner becomes fluidic during a coalescence at a temperature higher than the melting point of the wax after the agglomeration, and thus, the wax is exposed on a surface of the toner. In addition, small particulate toner (<D16) having lower compatibility with a resin than large particulate toner (>D16) has a low amount of wax, and thus an image quality may be deteriorated due to stains formed during the development process.

SUMMARY

The present general inventive concept provides an electrophotographic toner providing improved image quality.

Additional features and/or utilities of the present general inventive concept will be set forth in part in the description which follows and, in part, will be obvious from the description, or may be learned by practice of the general inventive concept.

The present general inventive concept may be achieved by providing an electrophotographic toner comprising a latex, a coloring agent, and a release agent, wherein a difference between an average circularity of toner having a particle size of D16p or less (S16) and an average circularity of toner having a particle size of D50p or less (S50) is about 0.01 or less, wherein the circularity is measured using a flow particle image analyzer (FPIA), the ratio of an area of wax to a total cross-sectional area of the toner having a particle size of D16p or less is about 8/100 or larger, and wherein the area is measured using a transmission electron microscope (TEM), and D16p and D50p respectively indicate particle sizes corresponding to 16% and 50% of a number cumulative distribution in which the toner particles are accumulated from particles of the smallest size to those of the largest size in ascending order.

A number average particle size of the toner may be in the range of about 3 μm to about 10 μm.

The toner may include sulfur, iron, and silicon, and when the amounts of the sulfur [S], the iron [Fe], and the silicon [Si] are measured using an X-ray fluorescence analysis, the ratio of [S]/[Fe] is in the range of about $5.0\times10^{-4}$ to about $5.0\times10^{-2}$ and the ratio of [Si]/[Fe] is in the range of about $5.0\times10^{-4}$ to about $5.0\times10^{-2}$.

The release agent may include a mixture of a paraffin-based wax and an ester-based wax or an ester group-containing paraffin-based wax.

If the releasing agent comprises a mixture including a paraffin-based wax and an ester-based wax, the amount of the ester-based wax may be in the range of about 5% to about 39% by weight, based on the total weight of the release agent.

An average circularity of the toner may be in the range of about 0.940 to about 0.990.

A volume average particle diameter distribution coefficient (GSDv) of the toner may be about 1.30 or less, and a number average particle diameter distribution coefficient (GSDp) of the toner may be about 1.30 or less.

The present general inventive concept may also be achieved by providing a method of preparing an electrophotographic toner, wherein the method includes preparing a mixture of a first latex, a coloring agent dispersion, and a release agent dispersion, preparing a first agglomerated toner by adding an agglomerating agent to the mixture, and preparing a second agglomerated toner by coating a second latex prepared by polymerizing at least one polymerizable monomer on the first agglomerated toner, wherein a difference between an average circularity of toner having a particle size of D16p or less (S16) and an average circularity of toner having a particle size of D50p or less (S50) is about 0.01 or less, wherein the circularity is measured using a flow particle image analyzer (FPIA), the ratio of an area of wax to a total cross-sectional area of the toner having a particle size of D16p or less is about 8/100 or larger, and wherein the area is measured using a transmission electron microscope (TEM), and D16p and D50p respectively indicate particle sizes corresponding to 16% and 50% of a number cumulative distribution in which the toner particles are accumulated from particles of the smallest size to those of the largest size in ascending order.

The first latex may be polyester, a polymer of at least one polymerizable monomer, or a mixture of the polyester and the polymer of at least one polymerizable monomer.

The method may further include coating a third latex prepared by polymerizing at least one polymerizable monomer on the second agglomerated toner.

The polymerizable monomer may include at least one selected from the group consisting of a styrene-based monomer, acrylic acid or methacrylic acid, a (meth) acrylic acid derivative, an ethylenically unsaturated mono-olefin, a halogenated vinyl, a vinyl ester, a vinyl ether, a vinyl ketone, and a nitrogen-containing vinyl compound.

The release agent dispersion may include a mixture of a paraffin-based wax and an ester-based wax or an ester group-containing paraffin-based wax.

The agglomerating agent may include a metal salt comprising silicon (Si) and iron (Fe).

The agglomerating agent may include poly silicate iron.

The present general inventive concept may also be achieved by providing a toner supplying unit comprising a toner tank to store toner, a supplying part projecting inside the toner tank to discharge the toner from the toner tank, and a toner agitating member rotatably disposed inside the toner tank to agitate the toner within an inner space of the toner tank including a location on a top surface of the supplying part, wherein the toner comprises the toner of claim 1.

The present general inventive concept may also be achieved by providing an imaging apparatus comprising an image carrier, an image forming unit that forms an electrostatic latent image on a surface of the image carrier, a unit receiving a toner, a toner supplying unit that supplies the toner onto the surface of the image carrier to develop the electrostatic latent image on the surface of the image carrier into a toner image, and a toner transferring unit that transfers the toner image to a transfer medium from the surface of the image carrier, wherein the toner comprises the toner of claim 1.

The present general inventive concept may also be achieved by providing an electrophotographic toner having a latex, a coloring agent, and a release agent comprising a first toner particle having a first size of D16p or less and a first circularity, the first toner particle including a wax disposed on an area thereof, and a second toner particle having a second size and a second circularity, wherein a difference between an average circularity of the first toner particle and an average circularity of the second toner particle is equal to or less than about 0.1, and wherein a ratio of the area of wax on the first toner particle to a cross-sectional area of the first toner particle is about 8/100.

The second size of the second toner particle may be D50p or less.

The first and second circularities may be measured by using a flow particle image analyzer.

A shape of the first toner particle may be a complex shape including an elliptical shape.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE EMBODIMENTS

Figure 1:
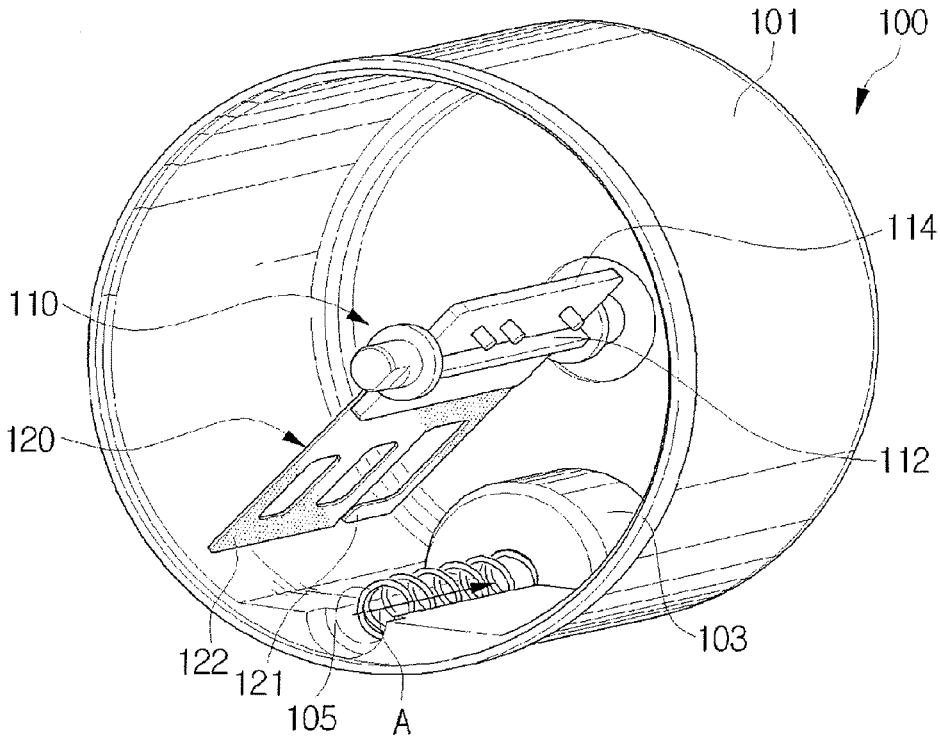
FIG. 1 illustrates a perspective view of a toner supplying unit according to an exemplary embodiment of the present general inventive concept.

The present general inventive concept will now be described more fully with reference to the accompanying drawings, in which exemplary embodiments of the present general inventive concept are illustrated, wherein like reference numerals refer to the like elements throughout. The embodiments are described below in order to explain the present general inventive concept by referring to the figures.

An electrophotographic toner according to an exemplary embodiment of the present general inventive concept includes a latex, a coloring agent, and a release agent, wherein a difference between an average circularity of the toner having a particle size of D16p or less (S16) and an average circularity of the toner having a particle size of D50p or less (S50) is about 0.01 or less, wherein the circularity is measured using a flow particle image analyzer (FPIA), the ratio of an area of wax to a total cross-sectional area of the toner having a particle size of D16p or less is about 8/100 or larger, wherein the area is measured using a transmission electron microscope (TEM), and D16p and D50p respectively indicate particle sizes corresponding to 16% and 50% of a number cumulative distribution in which the toner particles are accumulated from particles of the smallest size to those of the largest size in ascending order.

In general, a toner having a small particle size of D16p or less has a relatively lower amount of wax than a toner having a large particle size of D16p or larger due to compatibility with a latex. Thus, the toner having a small particle size may cause stains since the amount of the wax is relatively low as compared to that of the latex. The toner having low wax content has a spherical shape. However, since a spherical toner has poor cleaning properties, cleaning properties of the toner attached to a photoreceptor of an image forming apparatus may be reduced. That is, a toner particle having a spherical shape may be more difficult to clean from the photoreceptor, since the toner particle having a spherical shape has less surface area as compared to a toner particle having a larger particle size.

In exemplary embodiments, the shape of the toner having the small particle size is controlled to have a complex shape such as an elliptical shape or a potato shape rather than a spherical shape by increasing a ratio of an area of wax to a total cross-sectional area of toner having a particle size of D16p or less, wherein the area is measured using a TEM, and decreasing the difference between an average circularity of toner having a particle size of D16p or less S16 and an average circularity of toner having a particle size of D50p or less S50 is about 0.01 or less, wherein the circularity is measured using an FPIA, using a wax having appropriate compatibility with the latex and an agglomerating agent having excellent cohesive force. As a result, image quality and cleaning properties of the toner may be improved. However, the present general inventive concept is not limited thereto. That is, in alternative exemplary embodiments, the toner may be controlled to have various shapes in which a ratio of the surface area covered by wax to a total cross-sectional area of the toner is larger than that of a toner having a particle size of D16p or less with a spherical shape.

In this regard, the "circularity" is an index indicating how much the particle is close to a sphere. The circularity is measured using an FPIA-3000, manufactured by Sysmex Corporation and obtained by the equation below.

$$\text{Circularity}=2\times(\pi\times\text{area})^{0.5}/\text{circumference} \qquad \text{Equation}$$

The circularity refers to an index showing the surface unevenness of the toner particle, and may be in the range of 0 to 1. If a toner particle is a perfect sphere, the circularity is 1.00 and a toner particle having a complex shape has a low circularity.

An average circularity of the toner may be in the range of about 0.940 to about 0.990, about 0.945 to about 0.985, or about 0.950 to about 0.980. However, the present general inventive concept is not limited thereto.

If the average circularity of the toner is less than about 0.940, a height of the toner developed on the transfer medium is so high that the toner consumption increases. In addition, voids between the toner particles are so large that the image developed on the transfer medium may not have a sufficient coating rate, thereby increasing the toner consumption in order to obtain a sufficient toner image density. If the average circularity of the toner is larger than about 0.990, an excess of toner is supplied into a developing sleeve. Thus, toner is not uniformly coated on the developing sleeve, thereby contaminating the developing sleeve.

A difference between an average circularity of toner having a particle size of D16p or less S16 and an average circularity of toner having a particle size of D50p or less S50 may be about 0.01 or less, in the range of about 0.001 to about 0.01, or in the range of about 0.003 to about 0.01, wherein the circularity is measured using an FPIA.

D16p and D50p respectively indicate particle sizes corresponding to 16% and 50% of a number cumulative distribution in which the toner particles are accumulated from particles of the smallest size to those of the largest size in ascending order.

That is, the particle size of the toner is measured using an FPIA-3000 manufactured by Sysmex Corporation, and the toner particles are accumulated from particles of the smallest size to those of the largest size in ascending order to obtain a number cumulative distribution. In this regard, the 16% cumulative particle diameter is defined as D16p, and the 50% cumulative particle diameter is defined as D50p.

If the difference between the average circularity of toner having a particle size of D16p or less S16 and the average circularity of toner having a particle size of D50p or less S50 is larger than 0.01, the shape of the toner having small particle size is spherical. Thus, the toner having the small particle size may have poor cleaning properties and poor image quality.

The ratio of an area of wax to a total cross-sectional area of the toner having a particle size of D16p or less may be equal to or greater than about 8/100, in the range of about 8/100 to about 40/100, or in the range of about 10/100 to about 20/100, wherein the area is measured using a TEM. If the ratio of the area of wax to the total cross-sectional area is less than about 8/100, the amount of the wax is relatively low compared to that of the latex, thereby causing stains and decreasing image quality.

The toner may include sulfur, iron, and silicon. When the amounts of sulfur [S], iron Fe, and silicon (Si) are measured using an X-ray fluorescence analysis, the ratio of [S]/Fe may be in the range of about $5.0\times10^{-4}$ to about $5.0\times10^{-2}$ and the ratio of Si/Fe may be in the range of about $5.0\times10^{-4}$ to about $5.0\times10^{-2}$.

A chain transfer agent, which is a sulfur-containing compound, is used to control distribution of a molecular weight of the latex during the preparation of the latex of the toner. The amount of the sulfur [S] indicates the amount of the sulfur [S] contained in the chain transfer agent. Thus, if the amount of the sulfur [S] increases, the molecular weight of the latex decreases, so that a new chain may be initiated. Otherwise, if the amount of the sulfur [S] decreases, the growth of the chain continues to increase the molecular weight of the latex.

The amount of the iron [Fe] indicates the amount of iron in the agglomerating agent used to agglomerate the latex, the coloring agent, and the release agent during the preparation of the toner. Thus, the amount of the iron [Fe] may influence cohesive force of the agglomerated toner, particle size distribution, and particle size.

The amount of the silicon [Si] indicates the amount of silica particles used as external additives to obtain fluidity of poly silica used in the agglomerating agent, and fluidity of the toner. The amount of the silicon [Si] may influence cohesive force of the agglomerated toner, particle size distribution, and particle size as the iron, and fluidity of the toner.

In exemplary embodiments, the ratio of [S]/[Fe] may be in the range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

If the ratio of [S]/[Fe] is less than $5.0\times10^{-4}$, the amount of the sulfur [S] is so low that the molecular weight of the latex increases, or the amount of the iron [Fe] is so high that cohesiveness or charging properties may be deteriorated. If the ratio of [S]/[Fe] is larger than $5.0\times10^{-2}$, the amount of the sulfur [S] is so high that the molecular weight of the latex decreases, or the amount of the iron [Fe] is so low that cohesive force may decrease, thereby influencing the particle size distribution or the particle size.

The ratio of [S]/[Fe] may be in the range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

If the ratio of [S]/[Fe] is less than $5.0\times10^{-4}$, the amount of silica, as an external additive, is so low that the fluidity of the toner may decrease. If the ratio of [S]/[Fe] is larger than $5.0\times10^{-2}$, the amount of silica is so high that the inside of the printer may be contaminated.

A method of preparing an electrophotographic toner according to an exemplary embodiment of the present general inventive concept may include preparing a mixture of a first latex, a coloring agent dispersion, and a release agent dispersion, preparing a first agglomerated toner by adding an agglomerating agent to the mixture, and preparing a second agglomerated toner by coating a second latex prepared by polymerizing at least one polymerizable monomer on the first agglomerated toner, wherein the difference between an average circularity of toner having a particle size of D16p or less S16 and an average circularity of toner having a particle size of D50p or less S50 is about 0.01 or less, wherein the circularity is measured using an FPIA, the ratio of an area of wax to a total cross-sectional area of the toner having a particle size of D16p or less is about 8/100 or greater, wherein the area is measured using a TEM, and D16p and D50p respectively indicate particle sizes corresponding to 16% and 50% of a number cumulative distribution in which the toner particles are accumulated from particles of the smallest size to those of the largest size in ascending order.

In exemplary embodiments, the agglomerating agent may be sodium chloride (NaCl), magnesium chloride ($MgCl_2$), $MgCl_2.8H_20$, $[Al_2\ (OH)_nCl_{6-n}]_m$ $(Al_2\ (SO_4)_3.18H_2O$, polyaluminum chloride (PAC), polyaluminum sulfate (PAS), polyaluminum sulfate silicate (PASS), ferrous sulfate, ferric sulfate, ferric chloride, calcium hydroxide, calcium carbonate, a metal salt including Si and Fe, or the like. However, the present general inventive concept is not limited thereto.

In exemplary embodiments, an amount of the agglomerating agent may be in the range of about 0.1 to about 10 parts by weight, about 0.5 to about 8 parts by weight, and about 1 to about 6 parts by weight based on 100 parts by weight of the first latex. In this regard, if the amount of the agglomerating agent is less than about 0.1 parts by weight, agglomeration efficiency may decrease. If the amount of the agglomerating agent is larger than about 10 parts by weight, charging properties of the toner may decrease, and the particle size distribution may not be uniform.

According to the current exemplary embodiment, the electrophotographic toner uses a metal salt containing Si and Fe as an agglomerating agent. The amount of Si and Fe contained in the electrophotographic toner may be in the range of about 3 to about 30,000 ppm, about 30 to about 25,000 ppm, or about 300 to about 20,000 ppm. If the amount of Si and Fe is less than about 3 ppm, the effects of Si and Fe may be negligible. If the amount of Si and Fe is larger than about 30,000 ppm, charging properties of the toner may decrease, and the inside of the printer may be contaminated.

In exemplary embodiments, the metal salt containing Si and Fe may include poly silica iron. In particular, a size of the first agglomerated toner may increase by ionic strength increased by the addition of the metal salt containing Si and Fe and collision between particles. The metal salt containing Si and Fe may be poly silica iron such as PSI-025, PSI-050, PSI-085, PSI-100, PSI-200, and PSI-300 (manufactured by Suido Kiko Co.). Physical properties and compositions of PSI-025, PSI-050, and PSI-085 are illustrated in Table 1 below.

TABLE 1

| Type | | PSI-025 | PSI-050 | PSI-085 | PSI-100 | PSI-200 | PSI-300 |
|---|---|---|---|---|---|---|---|
| Silicon/Fe molar ratio (Si/Fe) | | 0.25 | 0.5 | 0.85 | 1 | 2 | 3 |
| Concentration of main component | Fe (wt %) | 5.0 | 3.5 | 2.5 | 2.0 | 1.0 | 0.7 |
| | $SiO_2$(wt %) | 1.4 | 1.9 | 2.0 | 2.2 | | |
| pH (1 w/v %) | | | | 2-3 | | | |
| Specific gravity (20° C.) | | 1.14 | 1.13 | 1.09 | 1.08 | 1.06 | 1.04 |
| Viscosity (mPa · S) | | | | 2.0 or greater | | | |
| Average molecular weight (Dalton) | | | | 500,000 | | | |
| Appearance | | | | Transparent liquid | | | |

Since the metal salt containing Si and Fe is used as the agglomerating agent, the toner may have a small particle size, and the shape of the particle may be controlled.

The number average particle size of the electrophotographic toner according to the current exemplary embodiment may be in the range of about 3 to about 10 μm, about 3 to about 8 μm, or about 4 to about 7.5.

In general, as the particle size of the toner decreases, resolution and image quality increase, but transfer speed and cleaning properties may decrease.

The number average particle size of the toner may be measured using an FPIA.

If the number average particle size of the electrophotographic toner is less than about 3 μm, cleaning properties of the photoreceptor and yield may decrease, and the electrophotographic toner is harmful due to scattering problems. If the number average particle size of the electrophotographic toner is larger than about 10 μl, a resolution and image quality may decrease, charging properties may not be uniform, fixing properties of the electrophotographic toner may decrease, and the toner layer may not be controlled by a Dr-Blade.

The indices of the particle size distribution of the electrophotographic toner may be a volume average particle size distribution index (GSDv) or a number average particle size distribution index (GSDp), which may be calculated as follows.

First, the size of the toner particle is measured using a multisizer III (manufactured by Beckman-Coulter Inc.), as a coulter counter, and toner particles are accumulated from particles of the smallest size to those of the largest size in ascending order to obtain a volume cumulative distribution and a number cumulative distribution. Then, the particle sizes corresponding to 16% of the volume and number cumulative distributions are respectively defined as volume average particle size D16v and number average particle size D16p. The particle sizes corresponding to 50% of the volume and number cumulative distributions are respectively defined as volume average particle size D50v and number average particle size D50p. In the same way, the particle size corresponding to 84% of the volume cumulative distribution is defined as volume average particle size D84v, and the particle size corresponding to 84% of the number cumulative distribution is defined as number average particle size D84p.

In this regard, the GSDv and the GSDp may be obtained using the relations as follows the GSDv is defined as $(D84v/D16v)^{0.5}$, and the GSDp is defined as $(D84p/D16p)^{0.5}$.

In an exemplary embodiment, the GSDv and GSDp may respectively be equal to or less than about 1.30, in the range of about 1.15 to about 1.30, or in the range of about 1.20 to about 1.25. If the GSDv and GSDp are respectively larger than about 1.30, the particle size distribution may not be uniform.

The first latex may be polyester, a polymer obtained by polymerizing at least one polymerizable monomer, or a mixture thereof (a hybrid type). If the polymer is used as the first latex, the polymerizable monomers may be polymerized with a releasing agent such as a wax, or a releasing agent may be added to the polymer.

A first latex having a particle size of about 1 μm or less, in the range of about 100 to about 300 nm, or in the range of about 150 to about 250 nm may be prepared by emulsion polymerization.

The polymerizable monomer may be at least one monomer selected from the group consisting of styrene-based monomers such as styrene, vinyl toluene, and α-methyl styrene; acrylic acid or methacrylic acid; derivatives of (metha) acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, and metacryl amide; ethylenically unsaturated mono-olefins such as ethylene, propylene, and butylenes; halogenated vinyls such as vinyl chloride, vinylidene chloride, and vinyl fluoride; vinyl esters such as vinyl acetate, and vinyl propionate; vinyl ethers such as vinyl methyl ether, and vinyl ethyl ether; vinyl ketones such as vinyl methyl ketone, and methyl isoprophenyl ketone; and nitrogen-containing vinyl compounds such as 2-vinylpyridine, 4-vinylpyridine, and N-vinyl pyrrolidone. However, the present general inventive concept is not limited thereto.

A polymerization initiator and a chain transfer agent may be used in the preparation of the first latex for efficient polymerization.

Exemplary embodiments of the polymerization initiator include persulfate salts such as potassium persulfate, and ammonium persulfate, azo compounds such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethyl valeronitrile), 2,2'-azobis isobutyronitrile, and 1,1'-azobis(1-cyclohexanecarbonitrile), and peroxides such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate, and di-t-butylperoxy isophthalate. In alternative exemplary embodiments, an oxidization-reduction initiator in which the polymerization initiator and a reduction agent are combined may be used.

A chain transfer agent is a material that converts a type of chain carrier in a chain reaction. A new chain has much less activity than that of a previous chain. A degree of polymerization of the polymerizable monomer may be reduced and new chains may be initiated using the chain transfer agent. In addition, a molecular weight distribution may be adjusted using the chain transfer agent.

In exemplary embodiments, an amount of the chain transfer agent may be in the range of about 0.1 to about 5 parts by weight, about 0.2 to about 3 parts by weight, or about 0.5 to about 2.0 parts by weight, based on 100 parts by weight of at least one polymerizable monomer. If the amount of the chain transfer agent is less than about 0.1 parts by weight, the molecular weight of the latex is so high that agglomeration efficiency may decrease. If the amount of the chain transfer agent is larger than about 5 parts by weight, the molecular weight of the latex is so low that fixing properties may decrease.

Exemplary embodiments of the chain transfer agent include sulfur-containing compounds such as dodecanthiol, thioglycolic acid, thioacetic acid, and mercaptoethanol, phosphorous acid compounds such as phosphorous acid and sodium phosphite, hypophosphorous acid compounds such as hypophosphorous acid and sodium hypophosphite, and alcohols such as methyl alcohol, ethyl alcohol, isopropyl alcohol, and n-butyl alcohol. However, the present general inventive concept is not limited thereto.

The first latex may further include a charge control agent. The charge control agent may be a negative charge control agent or a positive charge control agent. Exemplary embodiments of the negative charge control agent include an organic metal complex or a chelate compound such as an azo complex containing chromium or a mono azo metal complex, a salicylic acid compound containing metal such as chromium, iron and zinc, and an organic metal complex of an aromatic hydroxycarboxylic acid and an aromatic dicarboxylic acid, and any other known negative charge control agents may be used without limitation. Exemplary embodiments of the positive charge control agent include nigrosine and products of nigrosine modified with a fatty acid metal salt and an onium salt including a quaternary ammonium salt such as tributylbenzylammonium 1-hydroxy-4-naphthosulfonate and tetrabutylammonium tetrafluoroborate. These positive charge control agents may be used alone or in combination of two or more. Since the charge control agent stably and quickly charges a toner by its electrostatic force, the toner may be stably supported on a developing roller.

The prepared first latex is mixed with a coloring agent dispersion and a release agent dispersion. The coloring agent dispersion may be prepared by homogeneously dispersing a composition including a coloring agent, such as black, cyan, magenta, or yellow, and an emulsifier using an ultrasonic dispersing apparatus or a microfluidizer.

Among the coloring agent used in the coloring agent dispersion, carbon black or aniline black may be used as the pigment for a black toner, and for color toner, at least one of yellow, magenta, and cyan pigments are further contained.

A condensation nitrogen compound, an isoindolinone compound, an anthraquine compound, an azo metal complex, or an allyl imide compound may be used for the yellow coloring agent. Particularly, C.I. pigment yellow 12, 13, 14, 17, 62, 74, 83, 93, 94, 95, 109, 110, 111, 128, 129, 147, 168, 180, or the like may be used.

A condensation nitrogen compound, an anthraquine compound, a quinacridone compound, a base dye lake compound, a naphthol compound, a benzo imidazole compound, a thioindigo compound, or a perylene compound may be used for the magenta coloring agent. Particularly, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be used.

A copper phthalocyanine compound and derivatives thereof, an anthraquine compound, or a base dye lake compound may be used for the cyan coloring agent. Particularly, C.I. pigment blue 1, 7, 15, 15:1, 15:2, 15:3, 15:4, 60, 62, 66, or the like may be used.

Such coloring agents may be used alone or in a combination of at least two pigments, and are selected in consideration of color, chromacity, luminance, resistance to weather, dispersion property in toner, etc.

The amount of the coloring agent may be sufficient to color the toner. For example, the amount of the coloring agent may be in the range of about 0.5 to about 15 parts by weight, about 1 to about 12 parts by weight, or about 2 to about 10 parts by weight based on 100 parts by weight of the toner. If the amount of the coloring agent is less than about 0.5 parts by weight based on 100 parts by weight of the toner, coloring effects may not be sufficient. If the amount of the coloring agent is greater than about 15 parts by weight based on 100 parts by weight of the toner, the manufacturing costs of the toner may increase, and a sufficient frictional charge amount may not be obtained.

In exemplary embodiments, an emulsifier that is known in the art may be used as the emulsifier used in the coloring agent dispersion. In this regard, an anionic reactive emulsifier, a non-ionic reactive emulsifier, or a mixture thereof may be used. The anionic reactive emulsifier may be HS-10 (Dai-ich kogyo, Co., Ltd.), Dowfax 2A1 (Rhodia Inc.), etc., and the non-ionic reactive emulsifier may be RN-10 (Dai-ichi kogyo, Co., Ltd.).

The release agent dispersion used in the process of preparing the toner includes a release agent, water, an emulsifier, etc.

The release agent provides toner that may be fixed on a final image receptor at a low temperature and may have excellent durability of a final image and resistance to abrasion. Thus, in alternative exemplary embodiments, the type and amount of the release agent are factors which may be used to determine properties of the toner The release agent may be polyethylene-based wax, polypropylene-based, silicon wax, paraffin-based wax, ester-based wax, carbauna wax, and metallocene wax. However, the present general inventive concept is not limited thereto. The melting point of the release agent may be in the range of about 50° C. to about 150° C. Components of the release agent physically adhere to toner particles, but may not covalently bind with the toner particles. Thus, toner that is fixed on a final image receptor at a low temperature and has excellent durability of a final image and resistance to abrasion may be provided.

The amount of the release agent may be in the range of about 1 to about 20 parts by weight, about 2 to about 16 parts by weight, or about 3 to about 12 parts by weight, based on 100 parts by weight of the toner. If the amount of the release agent is less than about 1 part by weight, toner particles may not be fixed at a low temperature. On the other hand, if the amount of the releasing agent is larger than about 20 parts by weight, storage stability may decrease and the manufacturing costs of the toner may increase.

In exemplary embodiments, the release agent may be an ester group-containing wax. Exemplary embodiments of the ester group-containing wax may be a mixture of an ester-based wax and a non-ester-based wax; or an ester group-containing wax prepared by adding an ester group to a non-ester-based wax.

Since the ester group has high affinity with the latex of the toner, functions of the wax may be efficiently presented. Since the non-ester-based wax is released from the latex, excessive plasticity of the ester-based wax may be prevented or substantially reduced. Therefore, excellent developing properties of the toner may be maintained for a long period of time.

The ester-based wax may be an ester of a fatty acid group having 15 to 30 carbon atoms and a monohydric to pentahydric alcohol, such as behenic acid behenyl ester, stearic acid stearyl ester, stearate of pentaerythritol, montanic acid glyceride. In addition, the alcohol constituting the ester may have 10 to 30 carbon atoms. A multivalent alcohol may have 3 to 10 carbon atoms. However, the present general inventive concept is not limited thereto.

In addition, the non-ester-based wax may be polyethylene-based wax, paraffin wax, etc.

The ester group-containing wax may be a mixture of a paraffin-based wax and an ester-based wax; or an ester group-containing paraffin-based wax. Exemplary embodiments of the ester group-containing wax may be P-280, P-318, or P-319 manufactured by Chukyo yushi Co., Ltd.

If the release agent is a mixture of the paraffin-based wax and the ester-based wax, the amount of the ester-based wax of the release agent may be in the range of about 5 to about 39% by weight, about 7 to about 36% by weight, or about 9 to about 33% by weight, based on the total weight of the release agent.

The amount of the ester group of the release agent may be in the range of about 5 to about 39% by weight, about 7 to about 36% by weight, or about 9 to about 33% by weight, based on the total weight of the release agent. However, if the amount of the ester group is less than about 5% by weight, compatibility with the latex may decrease. On the other hand, if the amount of the ester group is larger than about 39% by weight, plasticity of the toner is so large that the developing property is maintained for a long period of time.

In alternative exemplary embodiments, any emulsifier that is known in the art may be used as the emulsifier used in the release agent dispersion. In this regard, an anionic reactive emulsifier, a non-ionic reactive emulsifier, or a mixture thereof may be used. The anionic reactive emulsifier may be HS-10 (Dai-ich kogyo, Co., Ltd.), Dawfax 2-A1 (Rhodia Inc.), etc. The non-ionic reactive emulsifier may be RN-10 (Dai-ichi kogyo, Co., Ltd.).

A molecular weight, a glass transition temperature (Tg), and rheological properties of a first latex prepared according to the method may be controlled to be fixed at a low fixing temperature.

The prepared first latex, the coloring agent dispersion, and the release agent dispersion are mixed, and then the agglomerating agent is added to the mixture to prepare agglomerated toner. In more particular, when the first latex, the coloring agent dispersion, and the release agent dispersion are mixed, the agglomerating agent is added to the mixture at a pH ranging from about 1 to about 4 to form a first agglomerated toner having an average particle size of about 2.5 μm as a core. Then, a second latex is added to the resultant, and the pH is adjusted to about 6 to about 8, the resultant is heated to a temperature in the range of about 90° C. to about 98° C., and the pH is adjusted to about 5 to about 6 to prepare a second agglomerated toner.

The agglomerating agent may be at least one metal salt including Si and Fe. The metal salt including Si and Fe may be poly silica iron. However, the present general inventive concept is not limited thereto.

The second latex may be prepared by polymerizing one or more polymerizable monomers. The polymerizable monomers are emulsion polymerized to prepare latex having a particle size of about 1 μm or less, or in the range of about 100 nm to about 300 nm. The second latex may also include a wax, and the wax may be added to the second latex in the polymerization process.

Meanwhile, a third latex prepared by polymerizing at least one polymerizable monomer may be coated on the second agglomerated toner.

By forming a shell layer with the second latex or the third latex, a durability of the toner may be improved, and storage problems of the toner during shipping and handling may be overcome. Here, an inhibitor may further be added to the reactor to prevent new latex particles from being formed, or the reaction may be performed using starved-feed processes to facilitate coating of the monomer mixture on the toner.

The prepared second agglomerated toner or third agglomerated toner is filtered to separate toner particles, and the toner particles are dried. The dried toner particles are subjected to a surface treatment process with external additives, and the charge amount is controlled to prepare a final dry toner.

The external additives may be silica, $TiO_2$, or the like. The amount of the external additives may be in the range of about 1.5 to about 7 parts by weight, or in the range of about 2 to about 5 parts by weight, based on 100 parts by weight of the toner which is not surface-treated with the external additives. If the amount of the external additives is less than 1.5 parts by weight, caking, by which toner particles agglomerate due to agglomerating forces, may occur, and the charge amount is unstable. If the amount of the external additives is larger than 7 parts by weight, an excess amount of external additives may contaminate the roller.

An image forming method according to another exemplary embodiment of the present general inventive concept includes forming a visualized image by attaching toner to the surface of a photoreceptor on which a latent image is to be formed and transferring the visualized image to a transfer medium, wherein the difference between an average circularity of toner having a particle size of D16p or less S16 and an average circularity of toner having a particle size of D50p or less S50 is about 0.01 or less, wherein the circularity is measured using an FPIA, the ratio of an area of wax to a total cross-sectional area of the toner having a particle size of D16p or less is about 8/100 or greater, wherein the area is measured using a TEM, and D16p and D50p respectively indicate particle sizes corresponding to 16% and 50% of a number cumulative distribution in which the toner particles are accumulated from particles of the smallest size to those of the largest size in ascending order.

A representative electrophotographic image forming process includes a series of processes of forming images on a receptor, the processes including charging, exposure to light, developing, transferring, fixing, cleaning, and erasing process operations.

In the charging process, a surface of a photoreceptor is charged with negative or positive charges, as desired, by a corona or a charge roller. In the light exposing process, an optical system, conventionally a laser scanner or an array of diodes, selectively discharges the charged surface of the photoreceptor in an image-wise manner corresponding to a final visual image formed on a final image receptor to form a latent image. Electromagnetic radiation that may be referred to as "light" includes infrared radiation, visible light, and ultraviolet radiation.

In the developing process, appropriate polar toner particles generally contact the latent image of the photoreceptor, and conventionally, an electrically-biased developer having an identical potential polarity to the toner polarity is used. The toner particles move to the photoreceptor and are selectively attached to the latent image by electrostatic electricity, and form a toner image on the photoreceptor.

In the transferring process, the toner image is transferred to the final image receptor from the photoreceptor, and sometimes, an intermediate transferring element is used when transferring the toner image from the photoreceptor to aid the transfer of the toner image to the final image receptor.

In the fixing process, the toner image of the final image receptor is heated and the toner particles thereof are softened or melted, thereby fixing the toner image to the final image receptor. Another method of fixing is to fix toner on the final image receptor under high pressure with or without the application of heat.

In the cleaning process, residual toner remaining on the photoreceptor is removed.

Finally, in the erasing process, charges of the photoreceptor are exposed to light of a predetermined wavelength band and are reduced to be substantially uniform and of a low value, and thus, the residue of the organic latent image is removed and the photoreceptor is prepared for a next image forming cycle.

A toner supplying unit according to an exemplary embodiment of the present general inventive concept includes a toner tank for storing toner, a supplying part projecting inside the toner tank to discharge the toner from the toner tank, and a toner agitating member rotatably disposed inside the toner tank to agitate the toner in almost an entire inner space of the toner tank including a location on a top surface of the supplying part, wherein the toner is used to develop an electrostatic latent image and includes latex, a colorant, and a releasing agen, wherein the difference between an average circularity of toner having a particle size of D16p or less S16 and an average circularity of toner having a particle size of D50p or less S50 is about 0.01 or less, wherein the circularity is measured using an FPIA, the ratio of an area of wax to a total cross-sectional area of the toner having a particle size of D16p or less is about 8/100 or greater, wherein the area is measured using a TEM, and D16p and D50p respectively indicate particle sizes corresponding to 16% and 50% of a number cumulative distribution in which the toner particles are accumulated from particles of the smallest size to those of the largest size in ascending order.

FIG. 1 is a perspective view of a toner supplying apparatus 100 according to an exemplary embodiment of the present general inventive concept.

The toner supplying apparatus 100 includes a toner tank 101, a supplying part 103, a toner-conveying member 105, and a toner-agitating member 110.

The toner tank 101 stores a predetermined amount of toner and may be formed in a substantially hollow cylindrical shape.

The supplying part 103 is disposed at a bottom of an inside of the toner tank 101 and discharges the stored toner from the inside of the toner tank 101 to an outside of the toner tank 101. In an exemplary embodiment, the supplying part 103 may project from the bottom of the toner tank 101 to the inside of the toner tank 101 in a pillar shape with a semi-circular section. The supplying part 103 includes a toner outlet (not illustrated) to discharge the toner to an outer surface of the supplying part 103.

The toner-conveying member 105 may be disposed at a side of the supplying part 103 at the bottom of the inside of the toner tank 101. The toner-conveying member 105 may be formed in, for example, a coil spring shape. However, the present general inventive concept is not limited thereto. An end of the toner-conveying member 105 extends in an inside the supplying part 103 so that when the toner-conveying member 105 rotates, the toner in the toner tank 101 is conveyed to the inside of the supplying part 103. The toner conveyed by the toner-conveying member 105 is discharged to the outside through the toner outlet.

The toner-agitating member 110 is rotatably disposed inside the toner tank 101 and forces the toner in the toner tank 101 to move in a radial direction. In an exemplary embodiment, when the toner-agitating member 110 rotates at a middle of the toner tank 101, the toner in the toner tank 101 is agitated to prevent or substantially reduce the toner from solidifying. As a result, the toner moves down to the bottom of the toner tank 101 by its own weight. The toner-agitating member 110 includes a rotation shaft 112 and a toner agitating film 120. The rotation shaft 112 may be rotatably disposed at the middle of the toner tank 101 and has a driving gear (not illustrated) coaxially coupled with an end of the rotation shaft 112 projecting from a side of the toner tank 101. Therefore, the rotation of the driving gear causes the rotation shaft 112 to rotate. Also, the rotation shaft 112 may have a wing plate 114 to help fix the toner agitating film 120 to the rotation shaft 112. In exemplary embodiments, the wing plate 114 may be formed to be substantially symmetric about the rotation shaft 112. The toner agitating film 120 has a width corresponding to the inner length of the toner tank 101. Furthermore, the toner agitating film 120 may be elastically deformable. In an exemplary embodiment, the toner agitating film 120 may bend toward or away from a projection inside the toner tank 101, i.e., the supplying part 103.

Portions of the toner agitating film 120 may be cut off from the toner agitating film 120 toward the rotation shaft 112 to form a first agitating part 121 and a second agitating part 122.

An imaging apparatus according to an exemplary embodiment of the present general inventive concept includes an image carrier, an image forming unit that forms an electrostatic latent image on a surface of the image carrier, a unit receiving a toner, a toner supplying unit that supplies the toner onto the surface of the image carrier to develop the electrostatic latent image on the surface of the image carrier into a toner image, and a toner transferring unit that transfers the toner image to a transfer medium from the surface of the image carrier, wherein the toner includes a latex, a colorant, and a releasing agent wherein the difference between an average circularity of toner having a particle size of D16p or less S16 and an average circularity of toner having a particle size of D50p or less S50 is about 0.01 or less, wherein the circularity is measured using an FPIA, the ratio of an area of wax to a total cross-sectional area of the toner having a particle size of D16p or less is about 8/100 or greater, wherein the area is measured using a TEM, and D16p and D50p respectively indicate particle sizes corresponding to 16% and 50% of a number cumulative distribution in which the toner particles are accumulated from particles of the smallest size to those of the largest size in ascending order.

Figure 2:
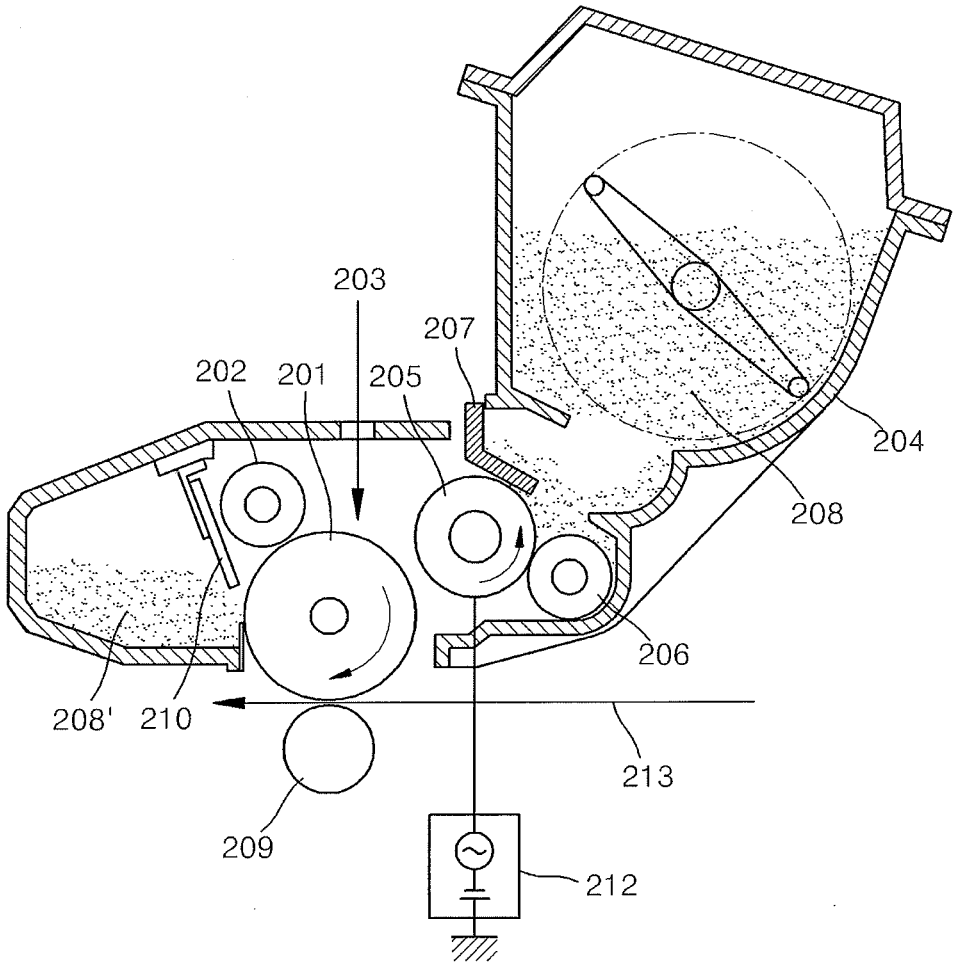
FIG. 2 illustrates a cross-sectional view of an image forming apparatus employing a toner prepared according to another exemplary embodiment of the present general inventive concept.

FIG. 2 is a cross-sectional view of a non-contact development type imaging apparatus including toner prepared using a method according to an exemplary embodiment of the present general inventive concept.

A developer (such as toner) 208 which includes a nonmagnetic one-component of a developing device 204 is supplied to a developing roller 205 by a supply roller 206 formed of an elastic material, such as polyurethane foam or sponge. However, the present general inventive concept is not limited thereto. The developer 208 supplied to the developing roller 205 reaches a contact portion between a developer controlling blade 207 and the developing roller 205 due to a rotation of the developing roller 205. The developer controlling blade 207 may be formed of an elastic material, such as metal or rubber. However, the present general inventive concept is not limited thereto. When the developer 208 passes through the contact portion between the developer controlling blade 207 and the developing roller 205, the developer 208 is controlled and formed into a thin layer which has a uniform thickness and is sufficiently charged. The developer 208 which has been formed into the thin layer is transferred to a development region of a photoreceptor 201 that is an image carrier, in which a latent image is developed by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates in a clockwise direction.

The developer 208 which has been transferred to the development region of the photoreceptor 201 develops the latent image formed on the photoreceptor 201 by an electric force generated by a potential difference between a direct current (DC) biased alternating current (AC) voltage applied to the developing roller 205 and a latent potential of the photoreceptor 201 charged by a charging unit 202 so as to form a toner image.

The developer 208, which has been transferred to the photoreceptor 201, reaches a transfer unit 209 due to the rotation direction of the photoreceptor 201. The developer 208, which has been transferred to the photoreceptor 201, is transferred to a print medium 213 to form an image by the transfer unit 209 having a roller shape and to which a high voltage having a polarity opposite to the developer 208 is applied, or by corona discharging when the print medium 213 passes between the photoreceptor 201 and the transfer unit 209.

The image transferred to the print medium 213 passes through a high temperature and high pressure fusing device (not illustrated) and thus the developer 208 is fused to the print medium 213 to form the image. Meanwhile, a non-developed, residual developer 208' on the developing roller 205 is collected by the supply roller 206 to contact the developing roller 205, and the non-developed residual developer 208' on the photoreceptor 201 is collected by a cleaning blade 210. The processes described above may be repeated as many times as required to form images on the print medium 213.

The one or more exemplary embodiments will now be described in more detail with reference to the examples below, but is not limited thereto. These examples are for illustrative purposes only and are not intended to limit the scope of the one or more exemplary embodiments or the present general inventive concept.

Example 1

Synthesis of First Latex

A monomer mixture was prepared using the following procedure. A monomer mixture, including 234 g of styrene, 96 g of n-burylacrylate, 14 g of methacrylic acid, and 6.5 g of poly(ethyleneglycol)-ethyl ether methacrylate, was mixed with 2 g of 1,10-decanediol diacrylate, as a cross-linking agent, and 5 g of 1-dodecanthiol, as a chain transfer agent, in a 3 L beaker.

The monomer mixture was emulsified by adding 500 g of HS-10 aqueous solution (0-4%) thereto for 2 hours.

The monomer emulsion was added to a reactor heated to 80° C., and 100 g of 3.2% KPS aqueous solution, as an initiator, was added thereto. The resultant was purged with nitrogen gas for 2 hours, allowed to further react for 6 hours, and allowed to naturally cool. After the reaction, the particle size of the first latex, which was measured using a light scattering method using Horiba 910 was 180 nm. The first latex had a Mw of 68,000 measured using gel permeation chromatography (GPC) and a gel content of 2.5%.

Preparation of Coloring Agent Dispersion 10 g of a mixture of an anionic reactive emulsifier (HS-10; Dai-ich kogyo, Co., Ltd.) and a non-ionic reactive emulsifier (RN-10; Dai-ich kogyo, Co., Ltd.) in weight ratios illustrated in Table 2 below, 60 g of a pigment (black, cyan, magenta, and yellow), and 400 g of glass beads each having a diameter ranging from 0.8 mm to 1 mm were added to a milling bath. Then, the mixture was milled at room temperature to prepare a dispersion. The dispersion was prepared using an ultrasonic homogenizer (Sonic and materials, VCX750).

TABLE 2

| Color | Pigment | HS-10:RN-10 (weight ratio) | Particle size |
|---|---|---|---|
| Black | Mogul-L | 100:0 | 130 nm |
| | | 80:20 | 120 nm |
| | | 0:100 | 100 nm |
| Yellow | PY-84 | 100:0 | 350 nm |
| | | 50:50 | 290 nm |
| | | 0:100 | 280 nm |
| Magenta | PR-122 | 100:0 | 320 nm |
| | | 50:50 | 300 nm |
| | | 0:100 | 290 nm |
| Cyan | PB 15:4 | 100:0 | 130 nm |
| | | 80:20 | 120 nm |
| | | 80:30 | 120 nm |

Agglomeration and Preparation of Toner 500 g of deionized water, 136 g of the first latex for a core, 35 g of 19.5% cyan coloring agent dispersion (HS-10, 100%), and 28 g of a wax dispersion P-420 including 25-35% of paraffin wax and 5-10% of ester wax (manufactured by Chukyo yushi Co., Ltd) were added to a 1 L reactor. 15 g of nitric acid (0.3 mol) and 15 g of 16% PSI-100 (manufactured by Suido Kiko Co.), as an agglomerating agent, were added to the reactor. The mixture was stirred at 11,000 rpm for 6 minutes using a homogenizer to prepare a first agglomerated toner having a volume average particle size ranging from 1.5 to 2.5 μm. The resultant was added to a 1 L double jacketed reactor, and heated from room temperature to 51.5° C. (Tg of the latex-5° C.) at a rate of 0.5° C. per minute. When a volume average particle size of the first agglomerated toner reached about 5.8 μm, 64 g of the second latex prepared by polymerizing the polystyrene-based polymerizable monomer was added thereto. When the volume average particle size reached 6.0 μm, NaOH (1 mol) was added thereto to adjust the pH to 6.8. When the volume average particle size was constantly maintained for 10 minutes, the temperature was increased to 96° C. at a rate of 0.5° C./min. When the temperature reached 96° C., nitric acid (0.3 mol) was added thereto to adjust the pH to 5.9. Then, the resultant was agglomerated for 3 to 5 hours to obtain a second agglomerated toner having a volume average diameter ranging from 6 to 6.5 μm in a complex shape such as an elliptical shape or a potato-shape. Then, the second agglomerated toner was cooled to a temperature lower than $T_g$, was filtered to be separated, and was dried.

The dried toner particles were subjected to a surface treatment by adding 0.5 parts by weight of NX-90 (Nippon Aerosil), 1.0 parts by weight of RX-200 (Nippon Aerosil), 0.5 parts by weight of SW-100 (Titan Kogyo) to 100 parts by weight of the dried toner particles, and agitating the mixture in a mixer (KM-LS2K, Dae Hwa Tech Co., Ltd.) at 8,000 rpm for 4 minutes. Thus, toner having a D50p of 6.2 μm was obtained. The toner had a $T_g$ of 62.8° C., an S50, measured using an FPIA, of 0.973, a GSDp of 1.25, a GSDv of 1.21, and an average circularity (<D16) of 0.976.

Example 2

Toner was prepared in the same manner as in Example 1, except that 35 g of a black coloring agent dispersion (HS-10, 100%) was used instead of 35 g of the cyan coloring agent dispersion (HS-10, 100%). The toner had a D50p of 6.5 μm, a $T_g$ of 62.8° C., an S50, measured using an FPIA, of 0.974, a GSDp of 1.24, a GSDv of 1.21, and an average circularity (<D16) of 0.979.

Example 3

Toner was prepared in the same manner as in Example 1, except that 55 g of a magenta coloring agent dispersion (HS-10, 100%) was used instead of 35 g of the cyan coloring agent dispersion (HS-10, 100%). The toner had a D50p of 6.4 μm, a $T_g$ of 62.8° C., an S50, measured using an FPIA, of 0.973, a GSDp of 1.27, a GSDv of 1.22, and an average circularity (<D16) of 0.978.

Comparative Example 1

Toner was prepared in the same manner as in Example 1, except that polyaluminum chloride (PAC) was used instead of PSI-100 as the agglomerating agent. The toner had a D50p of 6.4 μm, a $T_g$ of 62.8° C., an S50, measured using an FPIA, of 0.973, a GSDp of 1.25, a GSDv of 1.21, and an average circularity (<D16) of 0.984.

Comparative Example 2

Toner was prepared in the same manner as in Example 1, except that $MgCl_2$ and NaCl (weight ratio 60:40) were used instead of PSI-100 as the agglomerating agent. The toner had a D50p of 6.5 μm, a $T_g$ of 62.8° C., an S50, measured using an FPIA, of 0.973, a GSDp of 1.26, a GSDv of 1.21, and an average circularity (<D16) of 0.986.

Comparative Example 3

Toner was prepared using suspension polymerization described below.

A monomer mixture, including 234 g of styrene, 96 g of n-burylacrylate, 14 g of methacrylic acid, and 6.5 g of poly (ethyleneglycol)-ethyl ether methacrylate, was mixed with 2 g of 1,10-decanediol diacrylate, as a cross-linking agent, and 5 g of 1-dodecanthiol, as a chain transfer agent, in a 3 L beaker.

35 g of a cyan coloring agent dispersion (HS-10, 100%), and 28 g of a 35% wax dispersion P-420, including 25-35% of paraffin wax and 5-10% of ester and having a melting point of 85° C. (manufactured by Chukyo yushi Co., Ltd), were added to the monomer mixture to prepare a monomer-coloring agent-wax mixture.

Then, the monomer-coloring agent-wax was added to a 3 L reactor including 12 g of polyvinyl alcohol (PVA217 manufactured by Kuraray, Japan) dispersed in 1,800 g of distilled water.

Then, the mixture was stirred at 11,000 rpm for 10 minutes using a homogenizer, and the mixture was polymerized at 85° C. for 6 hours while stirring at 250 to 300 rpm and cooled to prepare toner.

The toner had a D50p of 6.5 μm, a $T_g$ of 62.8° C., an S50, measured using an FPIA, of 0.987, a GSDp of 1.27, a GSDv of 1.22, and an average circularity (<D16) of 0.984.

Evaluation of Toner

<Measurement of S16 and S50>

The circularity was measured using an FPIA-3000, manufactured by Sysmex Corporation.

<Ratio of an Area of Wax to a Total Cross-Sectional Area of the Toner having a Particle Size of D16p or Less>

A cross-sectional area dyed using ruthenium (Ru) was observed using a TEM, and the total cross-sectional area refers to A, and the area of the wax refers to B. Then, the ratio B/A was obtained.

<Measurement of Tg of Toner>

Tg of toner was measured using a differential scanning calorimetry (DSC) based on ASTM3418-8.

<Evaluation of Image Quality>

In order to evaluate the prepared toner, the developer was filled in a CLP-300 (Samsung), and an image was printed. Then, the center of the image was observed with naked eyes.

◎: No defect

○: Slight unevenness of the center of the image

Δ: Unevenness of the center of the image

X: Unevenness of the center of the image, and reduction of glossiness

<Evaluation of Cleaning Properties>

In order to evaluate the prepared toner, the developer was filled in a CLP-300 (Samsung), and an image was printed. Then, the surface of an OPC drum was observed.

◎: Clean OPC

○: Small amount of toner remaining in OPC

Δ: Relatively large amount of toner remaining in OPC

X: Relatively large amount of toner remaining in OPC and filming

Evaluation results of the toner prepared according to Examples 1 to 3 and Comparative Examples 1 to 3 are illustrated in Table 3 below.

Referring to Tables 3 and 4, as the speed of the printing system increases, the number of stains increases, cleaning properties deteriorate, and developing quality deteriorates.

Since the toner having a particle size of D16p or less, prepared according to Comparative Example 1, has a spherical shape, the difference of average circularity with the toner having a particle size of D50p increases, and thus cleaning properties may deteriorate. Image quality may also deteriorate due to stains caused by the toner having a small particle size and having a small amount of the wax.

Since the toner having a particle size of D16p or less, prepared according to Comparative Example 2, has a relatively spherical shape, cleaning properties may deteriorate. Even though stains decreases, transfer efficiency may decrease.

The toner prepared according to Comparative Example 3 has a low difference between an average circularity of toner having a particle size of D16p or less S16 and an average circularity of toner having a particle size of D50p or less S50, but a small amount of wax in the toner having a particle size of D16p or less may cause stains, and thus an image quality may deteriorate.

On the other hand, with regard to toners prepared according to Examples 1 to 3, since the difference between an average circularity of toner having a particle size of D16p or less (S16) and an average circularity of toner having a particle size of D50p or less (S50) is relatively low, substantially improved cleaning properties may be obtained, and stains may decrease by increasing the amount of wax in the toner having a particle size of D16p or less, thereby improving an image quality.

According to the present general inventive concept, toner may have high image quality by reducing stains by increasing an amount of wax in the toner having a small particle size, and may have a high glossiness and a large fixing area by introducing a low-melting point wax.

TABLE 3

| | D50p | $T_g$ [° C.] | S50 | S16 | Ratio of area of wax to total cross-sectional area of toner having a particle size of D16p or less | after 100 initial printings (24 ppm) Image quality | after 100 initial printings (24 ppm) Cleaning properties | after 2,000 printings (24 ppm) Image quality | after 2,000 printings (24 ppm) Cleaning properties |
|---|---|---|---|---|---|---|---|---|---|
| Example 1 | 6.2 | 62.8 | 0.973 | 0.976 | 22/100 | ○ | ○ | ○ | ○ |
| Example 2 | 6.5 | 62.8 | 0.974 | 0.979 | 14/100 | ◎ | ◎ | ◎ | ○ |
| Example 3 | 6.4 | 62.8 | 0.973 | 0.978 | 13/100 | ○ | ◎ | ◎ | ○ |
| Comparative Example 1 | 6.4 | 62.8 | 0.973 | 0.984 | 7/100 | Δ | Δ | Δ | X |
| Comparative Example 2 | 6.5 | 62.8 | 0.973 | 0.986 | 16/100 | Δ | Δ | Δ | X |
| Comparative Example 3 | 6.5 | 62.8 | 0.987 | 0.984 | 5/100 | Δ | X | Δ | X |

TABLE 4

| | after 100 initial printings (36 ppm) Image quality | after 100 initial printings (36 ppm) Cleaning properties | after 2,000 printings (36 ppm) Image quality | after 2,000 printings (36 ppm) Cleaning properties |
|---|---|---|---|---|
| Example 1 | ○ | ○ | ○ | ○ |
| Example 2 | ◎ | ◎ | ○ | ○ |
| Example 3 | ○ | ◎ | ○ | ○ |
| Comparative Example 1 | Δ | Δ | x | x |
| Comparative Example 2 | ○ | Δ | x | x |
| Comparative Example 3 | Δ | X | x | x |

While the present general inventive concept has been particularly illustrated and described with reference to a few exemplary embodiments thereof, it will be understood by those of ordinary skill in the art that various changes in form and details may be made therein without departing from the spirit and scope of the present general inventive concept as defined by the following claims and their equivalents.

What is claimed is:

1. An electrophotographic toner having toner particles, the toner comprising:

a latex;

a coloring agent; and a release agent, wherein a difference between an average circularity S16 of the toner having a particle size of D16p or less and an average circularity S50 of the toner having a particle size of D50p or less is about 0.01 or less, wherein the average circularity is measured using a flow particle image analyzer (FPIA), a ratio of an area of wax to a total cross-sectional area of the toner having a particle size of D16p or less is 8/100 or greater, and wherein each of the areas is measured using a transmission electron microscope (TEM), and D16p and D50p respectively indicate particle sizes corresponding to 16% and 50% of a number cumulative distribution in which the toner particles are accumulated in ascending size order.

2. The electrophotographic toner of claim 1, wherein a number average particle size of the toner is in the range of 3 μm to 10 μm.

3. The electrophotographic toner of claim 1, wherein the toner comprises sulfur, iron, and silicon, and when the amounts of the sulfur [S], the iron [Fe], and the silicon [Si] are measured using an X-ray fluorescence analysis, the ratio of [S]/[Fe] is in the range of $5.0\times10^{-4}$ to $5.0\times10^{-2}$ and the ratio of [Si]/[Fe] is in the range of $5.0\times10^{-4}$ to $5.0\times10^{-2}$.

4. The electrophotographic toner of claim 1, wherein the release agent comprises a mixture of a paraffin-based wax and an ester-based wax or an ester group-containing paraffin-based wax.

5. The electrophotographic toner of claim 4, wherein if the releasing agent comprises a mixture including a paraffin-based wax and an ester-based wax, the amount of the ester-based wax is in the range of 5% to 39% by weight, based on a total weight of the release agent.

6. The electrophotographic toner of claim 1, having an average circularity ranging from 0.940 to 0.990.

7. The electrophotographic toner of claim 1, respectively having a volume average particle size distribution index (GSDv) and a number average particle size distribution index (GSDp) equal to or less than 1.30.

* * * * *